US006444965B1

(12) United States Patent
Ha et al.

(10) Patent No.: US 6,444,965 B1
(45) Date of Patent: Sep. 3, 2002

(54) MICROWAVE OVEN AND CONTROLLING METHOD FOR USE WITH THE INTERNET

(75) Inventors: Jae-Ki Ha, Seoul; Han-Gyu Ryu, Suwon; Joo-Hyun Do, Seoul, all of (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/605,408

(22) Filed: Jun. 28, 2000

(30) Foreign Application Priority Data

Aug. 19, 1999 (KR) ..... 99/34353

(51) Int. Cl.[7] ..... H05B 6/68

(52) U.S. Cl. ..... 219/702; 219/506; 219/714; 219/720; 99/325; 700/17; 700/211

(58) Field of Search ..... 219/702, 704, 219/720, 714, 506; 99/325; 700/207, 211, 17

(56) References Cited

U.S. PATENT DOCUMENTS

| | | | | | |
|---|---|---|---|---|---|
| 4,219,715 | A | * | 8/1980 | Mandle et al. | 219/755 |
| 4,340,800 | A | * | 7/1982 | Ueda et al. | 219/714 |
| 4,837,414 | A | * | 6/1989 | Edamula | 219/714 |
| 5,344,544 | A | * | 9/1994 | North et al. | 204/401 |
| 5,352,874 | A | * | 10/1994 | Gong | 219/720 |
| 5,677,613 | A | * | 10/1997 | Perelle | 320/6 |
| 5,949,977 | A | * | 9/1999 | Hernandez | 395/200.59 |
| 5,950,173 | A | * | 9/1999 | Perkowski | 705/26 |
| 6,049,831 | A | * | 4/2000 | Gardell et al. | 709/236 |
| 6,097,016 | A | * | 8/2000 | Hirata et al. | 219/720 |
| 6,121,593 | A | * | 9/2000 | Mansbery et al. | 219/720 |

FOREIGN PATENT DOCUMENTS

| | | | | |
|---|---|---|---|---|
| EP | 0 965 795 | * | 12/1999 | |
| EP | 0985884 A2 | | 3/2000 | |
| EP | 1016831 A1 | | 7/2000 | |
| GB | 2260002 A | | 3/1993 | |
| GB | 2300053 A | | 10/1996 | |
| JP | 57-58022 | * | 4/1982 | 219/714 |
| JP | 10-276478 | * | 10/1998 | |
| WO | WO 99/66673 A1 | | 2/1999 | |
| WO | WO 99/21325 A1 | | 4/1999 | |

OTHER PUBLICATIONS

Copy of a British Combined Search and Examination Report under Sections 17 and 18(3) dated Sep. 21, 2000.
Copy of an internet page: http://www.stanton–crenshaw.com/sharp_rel08.html.

* cited by examiner

*Primary Examiner*—Philip H. Leung
(74) *Attorney, Agent, or Firm*—Robert E. Bushnell, Esq.

(57) ABSTRACT

A microwave oven and a controlling method therefor employ a data receiving section connected to an external device which is connectable to the Internet to receive cooking data from the external device, and a driving section for performing the cooking operation by using the cooking data received from the Internet. The microwave oven also includes a memory for storing the cooking data received from the Internet. A user can select and cook his/her desired cooking menus from a wide range of cooking menus provided by the Internet, and can also adjust, replace and store the cooking data received from the Internet as he/she pleases.

26 Claims, 7 Drawing Sheets

MICROWAVE OVEN AND CONTROLLING METHOD FOR USE WITH THE INTERNET

This application makes reference to, incorporates the same herein, and claims all benefits accruing under 35 U.S.C. §119 from my application MICROWAVE OVEN AND A CONTROL METHOD THEREFOR filed with the Korean Industrial Property Office on Aug.19, 1999 and there duly assigned Serial No. 34353/1999.

BACKGROUND OF THE INVENTION

1. Field of the Invention

The present invention relates to a microwave oven and a controlling method therefor, and more particularly to a microwave oven and a controlling method therefor capable of receiving cooking data from the Internet and performing cooking operations according to the received cooking data.

2. Description of the Related Art

Generally, a microwave oven cooks food by using microwaves generated from a magnetron. In order to achieve the most appropriate cooking result, the microwave oven includes a manual cooking function enabling a user to adjust output levels and cooking time of the microwave oven manually. Further, there is an automatic cooking function for automatically cooking food simply by selecting a menu without having to separately adjust the cooking time, etc. Moreover, the microwave oven also includes a displaying function for displaying the operational status of the microwave oven, the menu, etc. for the user's convenience when operating the microwave oven.

The microwave oven usually includes control information about various cooking data preset therein. While the preset cooking control information seems convenient, since there is a wide range of cooking menus which vary according to particular countries, the likes or dislikes of the user, etc., there is a limit for storing such a wide range of cooking control data in one microwave oven. Further, even if a large amount of cooking control information is stored in the microwave oven, since there is a limited number of cooking materials usually cooked by the user according to his/her preferences, likes, etc., storing a great deal of cooking control information has relatively low practical use.

Recently, there are many computer users who get information from the Internet. By using the Internet, such a wide range of cooking control information can be obtained, and the user may select his/her desired cooking menu as he/she likes. Accordingly, there is a need for developing a microwave oven capable of receiving cooking recipes through the Internet.

SUMMARY OF THE INVENTION

The present invention has been developed to overcome the above-mentioned problems of the related art, and accordingly it is a first object of the present invention to provide a microwave oven capable of receiving cooking recipes from the Internet, performing the cooking operation according to the received cooking recipes, and storing the cooking recipes inputted from the Internet therein.

A second object of the present invention is to provide a controlling method for the above microwave oven.

The first object of the invention is accomplished by a microwave oven which includes: a data receiving section connected to an external device which is connectable to the Internet for receiving cooking data from the external device; and a driving section for performing cooking operations by using the cooking data received from the Internet.

The cooking data preferably includes at least a menu name, an output power level, and a cooking time.

The data receiving section includes an interface section for converting the data from the external device into a proper voltage level for a microcomputer in the microwave oven.

The interface section wave-detects a signal inputted from the external device by means of a diode, divides the wave-detected signal by means of a resistor, and stabilizes the divided voltage by means of a Zener diode.

An input end of the interface section comprises an audio female jack through which the data from an external device is inputted.

The microwave oven according to the present invention further includes a displaying section for displaying the cooking data received from the external device, a memory section for storing the cooking data received from the external device, means for storing the data in, or reading the data from, the memory section, and a user inputting section having an inputting part to adjust the cooking data received from the external device.

The microwave oven according to the present invention further includes a user inputting section having a cooking menu storing part for pre-storing at least one cooking data, and an inputting part for replacing the cooking data of the pre-stored cooking menu with the cooking data received from the external device, and for storing the cooking data received from the external device. The cooking menu storing means preferably comprises a microcomputer or a memory.

The second object of the invention is accomplished by a controlling method for a microwave oven which includes the steps of: (a) receiving cooking data from an external device connected to the Internet; and (b) performing the cooking operation by using the cooking data received from the external device.

Step (a) converts the data received from the external device connected to the Internet into a proper voltage level for the microcomputer in the microwave oven. The cooking data includes at least a menu name, an output power level, and a cooking time.

The controlling method according to the present invention further includes step (c) of storing the cooking data received from the external device, and step (d) of replacing cooking data pre-stored in a cooking menu storing means with the cooking data received from the external device, and storing the cooking data received from the external device.

The controlling method according to the present invention further includes step (e) of displaying the cooking data received from the external device, and step (f) of adjusting the cooking data received from the external device.

Furthermore, the second object of the invention is accomplished by a controlling method for a microwave oven which includes steps of: (a) receiving the cooking data from the external device connected to the Internet; and (b) storing the cooking data received from the external device.

By means of the microwave oven and the controlling method of the present invention, the user can cook food by using cooking data received from the Internet, while he/she may adjust, replace, or store the cooking data from the Internet as he/she pleases. Accordingly, the user can make full use of the microwave oven since he/she can select and cook his/her desired cooking menus from the wide range of cooking menus provided by the Internet, while also having the option of storing the cooking data for later use.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Hereinafter, the construction of the microwave oven according to the preferred embodiment of the present invention will be described.

Figure 1:
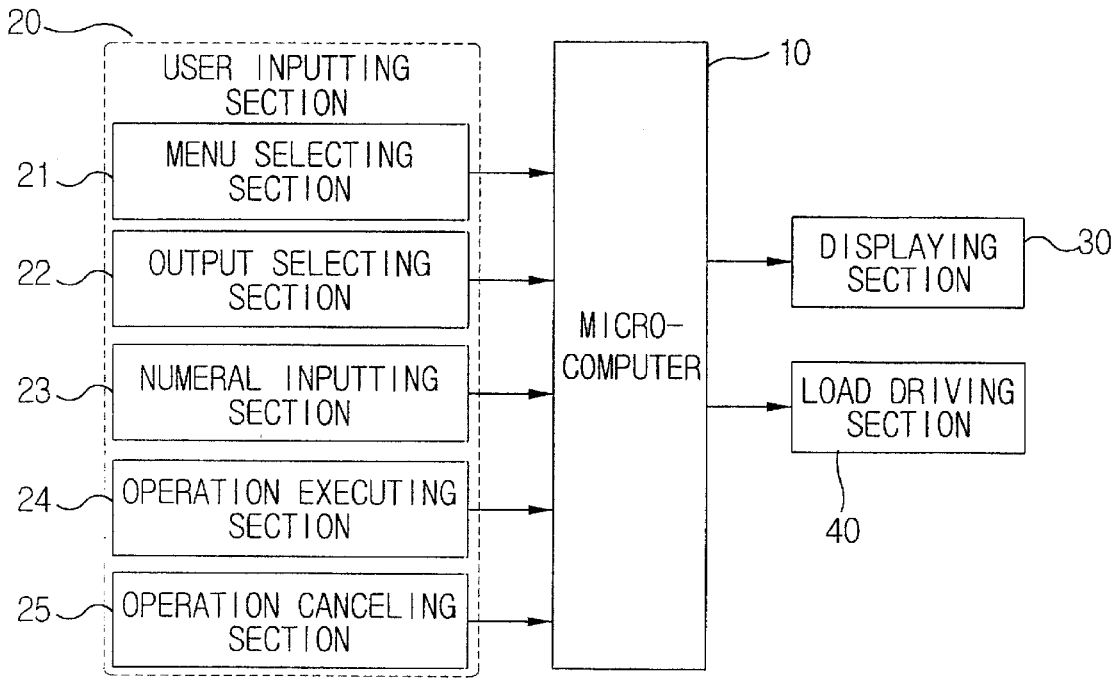
FIG. 1 is a block diagram for explaining the function of a microwave oven.

FIG. 1 is a block diagram for explaining the function of a microwave oven.

Referring to FIG. 1, a microcomputer 10 operates a load driving section 40 according to the user's selections as inputted through a user inputting section 20, while simultaneously displaying the status on a displaying section 30.

The user inputting section 20 includes a menu selecting section 21 for selecting various menus for automatic cooking operations, an output selecting section 22 for selecting the output level, a numeral inputting section 23 for inputting the cooking time, an operation executing section 24 for driving the microwave oven according to the set conditions, and an operation canceling section 25 for canceling the operation driving the microwave oven. The above sections may be implemented with buttons or dials.

The load driving section 40 includes a magnetron, a cooling fan, a lamp, and a driving motor to perform the cooking operation of the microwave oven.

Figure 2:
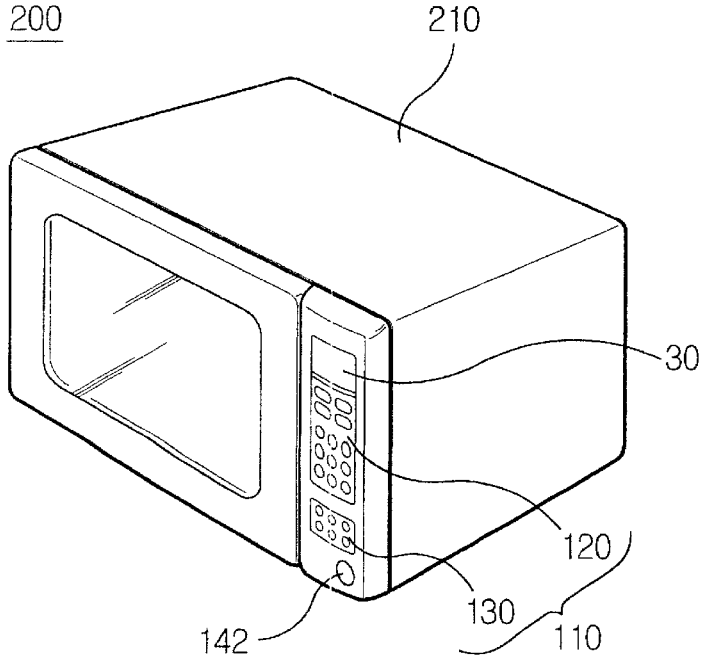
FIG. 2 is a perspective view showing the appearance of a microwave oven according to the preferred embodiment of the present invention.

FIG. 2 is a perspective view showing the appearance of a microwave oven 200 according to the preferred embodiment of the present invention. As shown, the microwave oven 200 includes a user inputting section 110 having a regular command inputting section 120 and an Internet command inputting section 130 formed on the front side of a body 210 thereof.

Further, the microwave oven 200 includes a data input port 142 for inputting a signal from the output section of an external device connectable to the Internet, such as the serial port of a personal computer.

The microwave oven 200 further includes a displaying section 30 for displaying the user's selections inputted from an inputting section 10. The displaying section 30 also displays the data inputted to the microwave oven 200 from the Internet.

Figure 3:
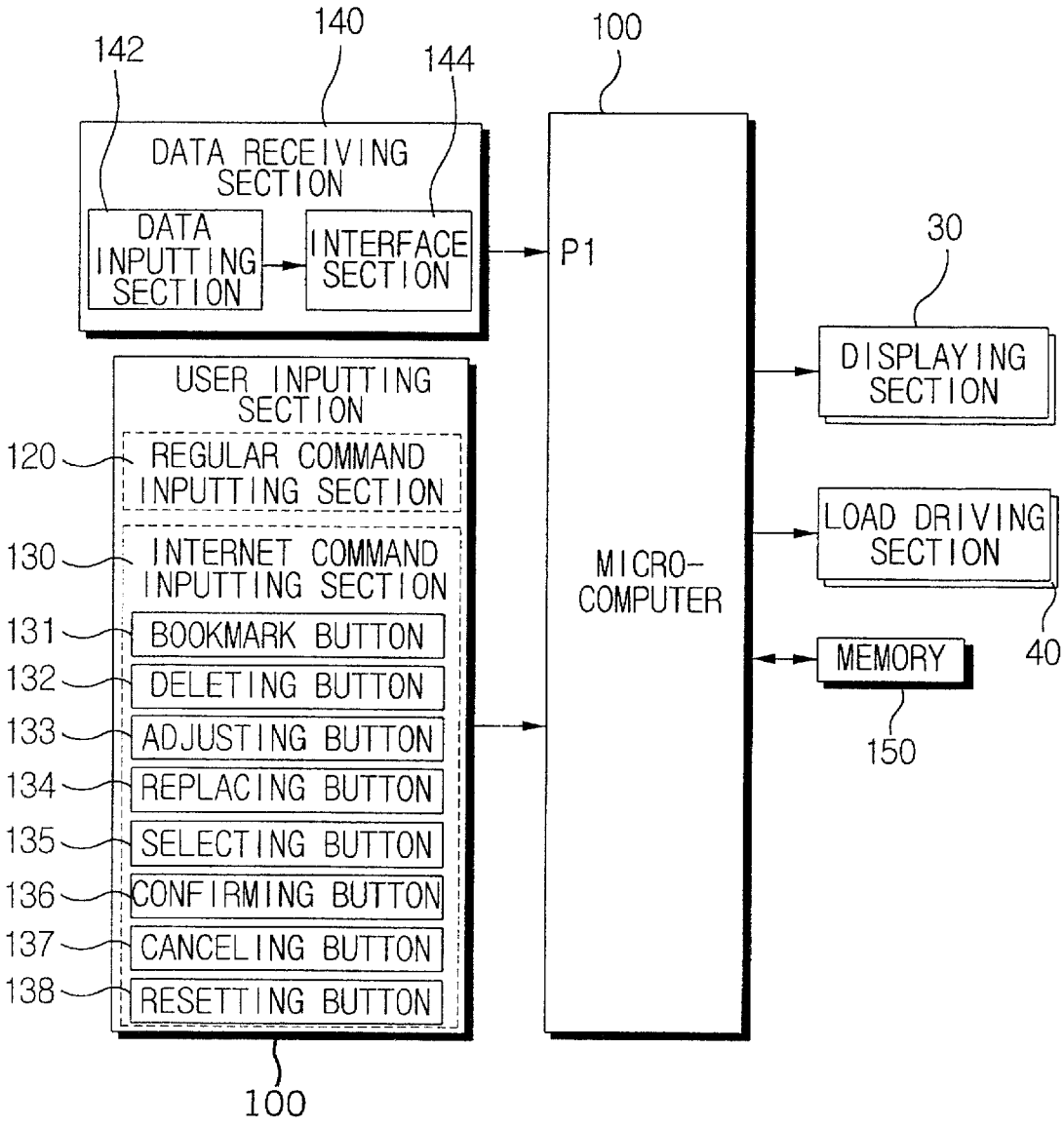
FIG. 3 is a control block diagram for explaining the function of the microwave oven in FIG. 2.

FIG. 3 is a control block diagram for explaining the function of the microwave oven in FIG. 2. As shown in FIG. 3, the user inputting section 110 of the microwave oven 200 includes a regular command inputting section 120, and an Internet command inputting section 130.

The regular command inputting section 120 includes a menu selecting section 21 (FIG. 1) for selecting various menus for automatic cooking operations, an output selecting section 22 for selecting output levels, a numeral inputting section 23 for inputting cooking time, an operation executing section 24 for driving the microwave oven according to the preset conditions, and an operation canceling section 25 for canceling the operation driving the microwave oven 200.

The Internet command inputting section 130 includes a bookmark button 131, a deleting button 132, an adjusting button 133, a replacing button 134, a selecting button 135, a confirming button 136, a canceling button 137, and a resetting button 138.

The bookmark button 131 stores the cooking data received from the Internet in the memory 150 of microwave oven 200, and sequentially displays the received data stored in memory 150.

The deleting button deletes certain data from the memory 150 when the whole range of data stored in the memory 150 is displayed on the displaying section 30.

The adjusting button 133 adjusts the data inputted to the microwave oven from the Internet as the user wishes.

The replacing button 134 replaces the preset cooking data in the memory 150 of the microwave oven 200 with the cooking data received by the microcomputer 100 of the microwave oven 200 from the Internet.

The selecting button 135 selects certain data from the data displayed on the displaying section 40, and selects the cooking data in the microcomputer 100 to be replaced by use of the replacing button 134.

The confirming button 136 is used when storing the cooking data inputted from the Internet instead of the cooking data selected by the selecting button 135.

The canceling button 137 cancels the operations of the respective buttons 131, 132,133, 134, 135, 136, and 137, and restores the original data.

The resetting button 130 restores the data stored in the memory 150 as the default data. The default data are the cooking data basically stored in the microcomputer 100 of the microwave oven 200.

In FIG. 3, the microwave oven 200 includes a data receiving section 140 connected to an external device connectable to the Internet for receiving the cooking data from the external device connectable to the Internet, such as a personal computer. The data receiving section 140 includes a data input port 142 for receiving data from the external device, and an interface section 144 for converting the data from the external device into the proper voltage level for the microcomputer 100.

Further, the microwave oven 200 includes a load driving section 40 having a magnetron, cooling fan, lamp, and driving motor for performing the cooking operation of the microwave oven; a microcomputer 100 for properly controlling the operations of the respective components in the microwave oven 200 according to the inputted signals; a memory 150 for storing the cooking data inputted from the Internet through the data receiving section 140; and a displaying section 30 for displaying the data inputted from the user inputting section 110 or the data receiving section 140.

Figure 4:
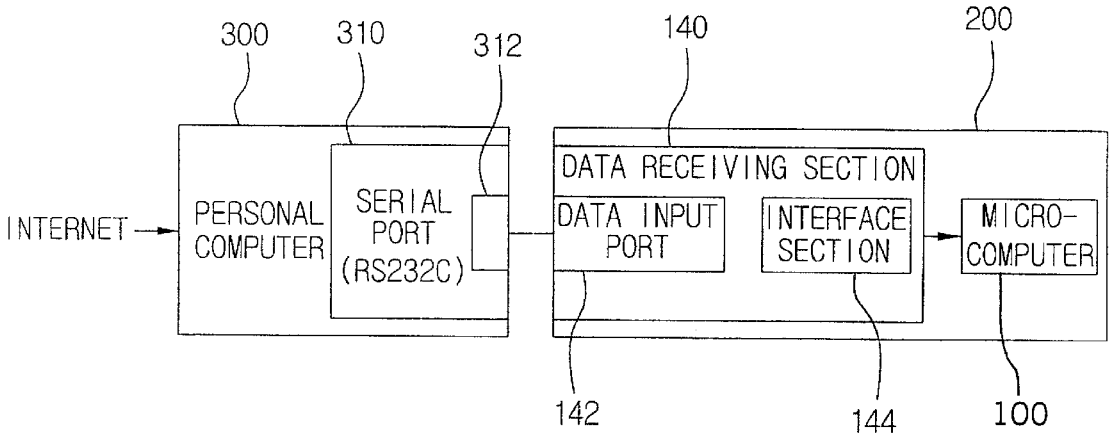
FIG. 4 is a schematic block diagram showing the connection of the microwave oven in FIG. 2 with the Internet.

FIG. 4 is a schematic block diagram showing the connection of the microwave oven of FIG. 2 with the Internet.

As shown in FIG. 4, the microwave oven 200 is connected with an external device connectable to the Internet, such as the personal computer 300 used in this embodiment. The personal computer 300 is provided with an Internet browser for surfing the Internet, and a communication program for outputting the data obtained from a Web site through the output port, such as an RS232C serial port 310, etc. The communication program is installed on personal computer 300 by downloading the same from the Web site. Accordingly, the user is connected to his/her desired cooking site of the Web site by using the Internet browser installed on personal computer 300. As the user clicks various cooking data such as the menu name, power level, cooking time, etc., the corresponding data are transferred to the personal computer 300 from the cooking site, and are then inputted by the communication program to the data input port 142 of the microwave oven 200 through the RS232C serial port 310.

Figure 5A:
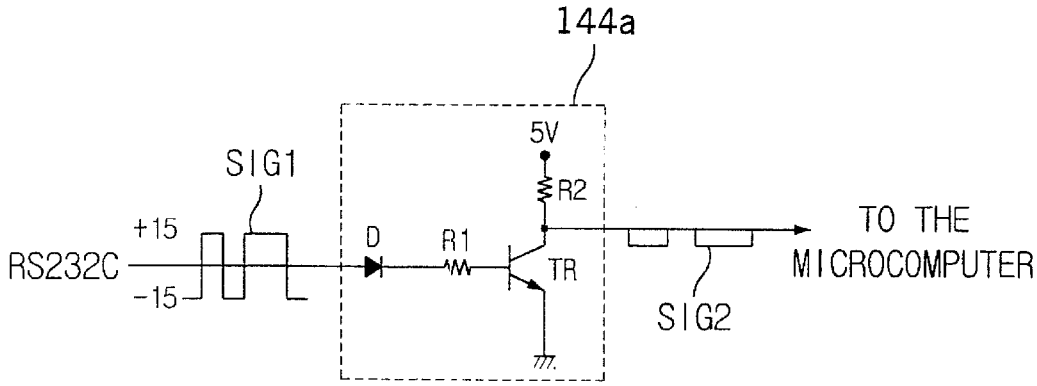
FIGS. 5A and 5B are views showing the interface circuit of FIG. 4 according to the respective embodiments.
Figure 5B:
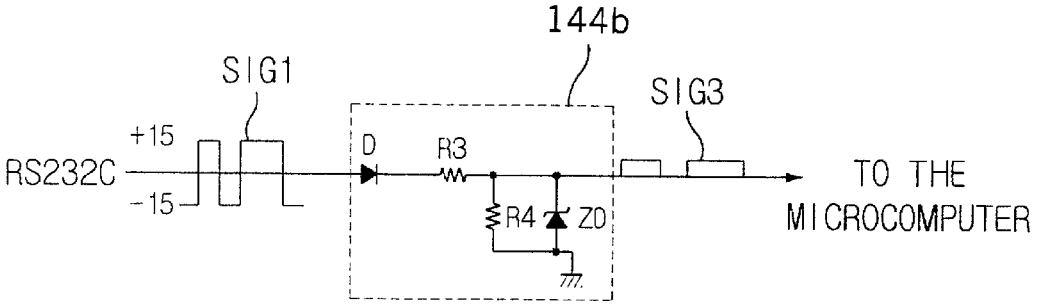

FIGS. 5A and 5B are views showing the interface circuit of FIG. 4 according to the respective embodiments. As shown in FIGS. 5A and 5B, the interface section 144 converts the signal from the RS232C serial output port 310 of the personal computer 300, and inputs the converted signal to the input terminal P1 (FIG. 3) of the microcomputer 100. That is, the output signal from the RS232C serial output port 310 is converted into a signal having the proper voltage level required by the microcomputer 100. According to the interrupt characteristic of the microcomputer 100, the output signal from the RS232C serial output port 310 may be phase-inverted as in the interface section 144*a* of FIG. 5A, or may be converted into the signal of proper voltage level required by the microcomputer 100 without being phase-inverted as in the interface section 144*b* of FIG. 5B.

As shown in FIG. 5A, the interface section 144*a* includes a diode D which is turned on/off according to the output signal from the RS232C port 310. Usually, the output signal from the RS232C port 310 is a pulse signal SIG1 ranging from −15V to +15V. The pulse signal passes through the diode D, and is applied to the base of a transistor TR via a resistor R1. In this situation, as a result of connection of a transistor driving power source to the collector of the transistor TR via a resistor R2, a certain phase-inverted voltage (such as 5V) is outputted, and the output phase-inverted signal is inputted to the microcomputer 100 as an input signal SIG2 of the microcomputer 100.

The interface section 144*b* of FIG. 5B has a diode D which is turned on/off according to the output pulse signal from the RS232C port 310. The pulse signal passes through the diode D, and is divided by resistors R3 and R4. The pulse signal divided by the resistors R3 and R4, is stabilized by a Zener diode ZD, and is then inputted to the microcomputer 100 as an input signal SIG3 of the microcomputer 100. The phase inverting and non-phase inverting interface circuits of FIGS. 5A and 5B, respectively, are alternatively used by the microcomputer 100.

Figure 6A:
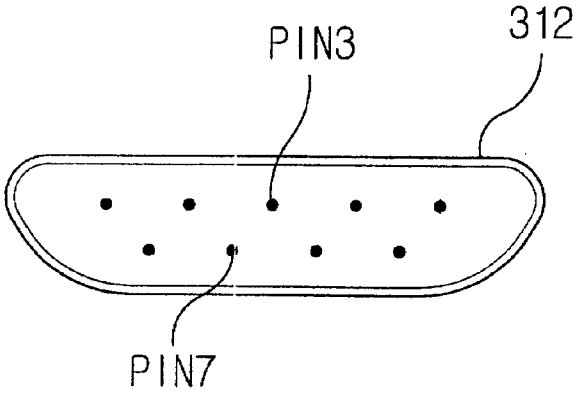
FIGS. 6A and 6B are views showing connecting terminals of the personal computer and the interface of the microwave oven of FIG. 4.
Figure 6B:
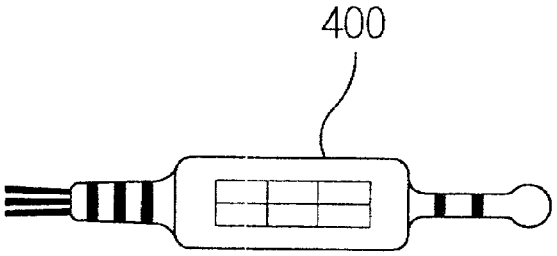

FIGS. 6A and 6B are views showing connecting terminals of the personal computer and the interface of the microwave oven of FIG. 4. As shown in FIG. 6A, the input/output port 312 of the RS232C serial port 310 of the personal computer 300 is connectable to a general audio male jack 400. For the connection thereof, a transmitting pin and a ground pin (such as PIN3 and PIN7 in FIG. 6A) of the input/output port 312 are used. Since the audio male jack 400 usually has three lines including the ground line, the data from the Internet can be transmitted from the RS232C input/output port 312 through the male jack 400. The audio male jack 400 is inserted into a data input port 142 (FIG. 2) formed on the microwave oven 200. Accordingly, the data input port 142 is preferably formed of an audio female jack. The audio male jack 400 is inserted into the audio female data input section 142 to apply the output pulse signal from the transmitting pin PIN3 to the diode D.

The microcomputer 100 displays the data inputted through the interface section 144, and starts the cooking operation. Further, the microcomputer 100 controls the operation of the microwave oven 200 according to the selected button input of the Internet command inputting section 130, and stores the inputted data in the memory 150.

The operation of the microwave oven 200 constructed as above will be described below.

Figure 7A:
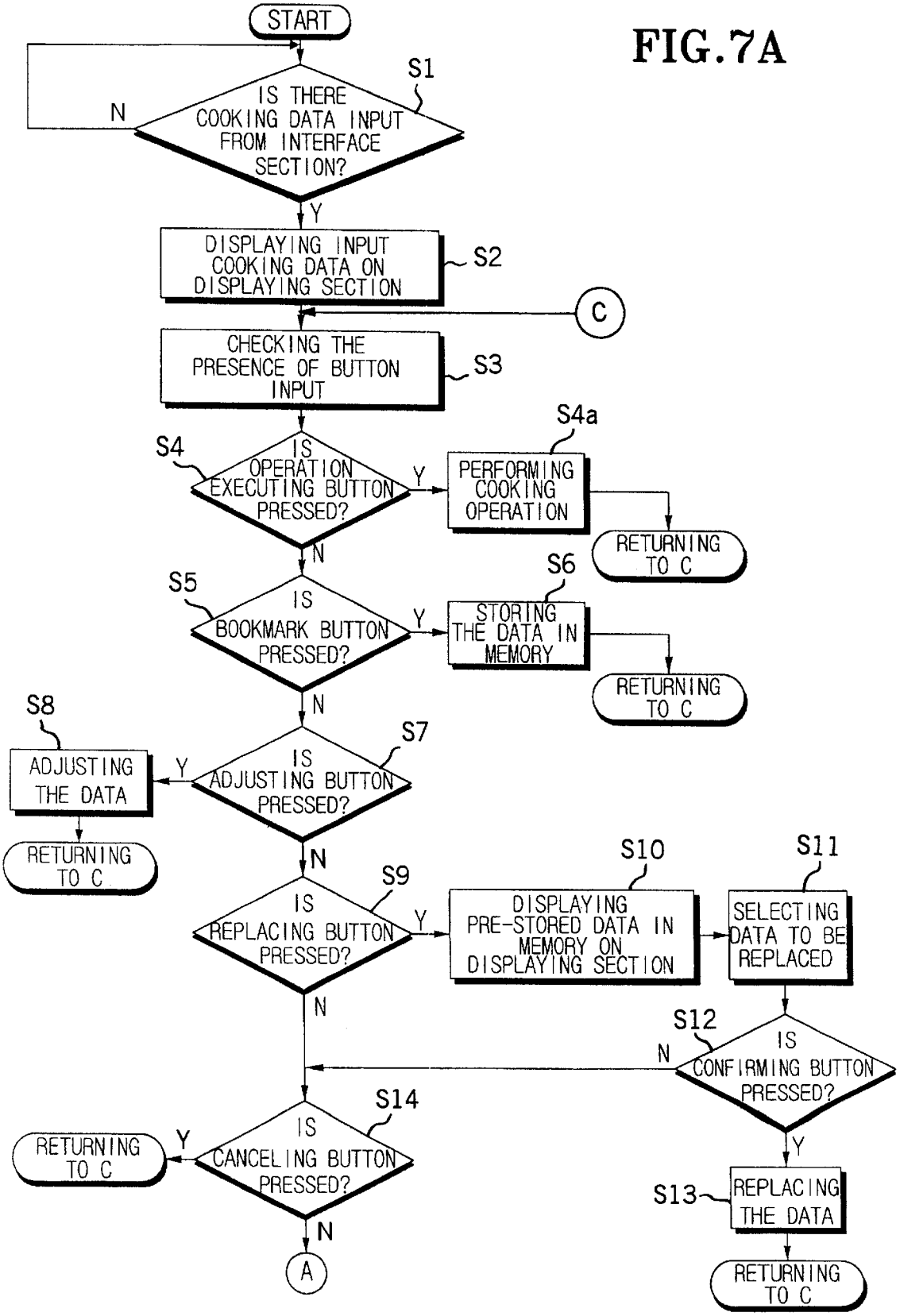
FIGS. 7A and 7B are flow charts which are linked by a reference character A for explaining the operation of the microwave oven according to the present invention.
Figure 7B:
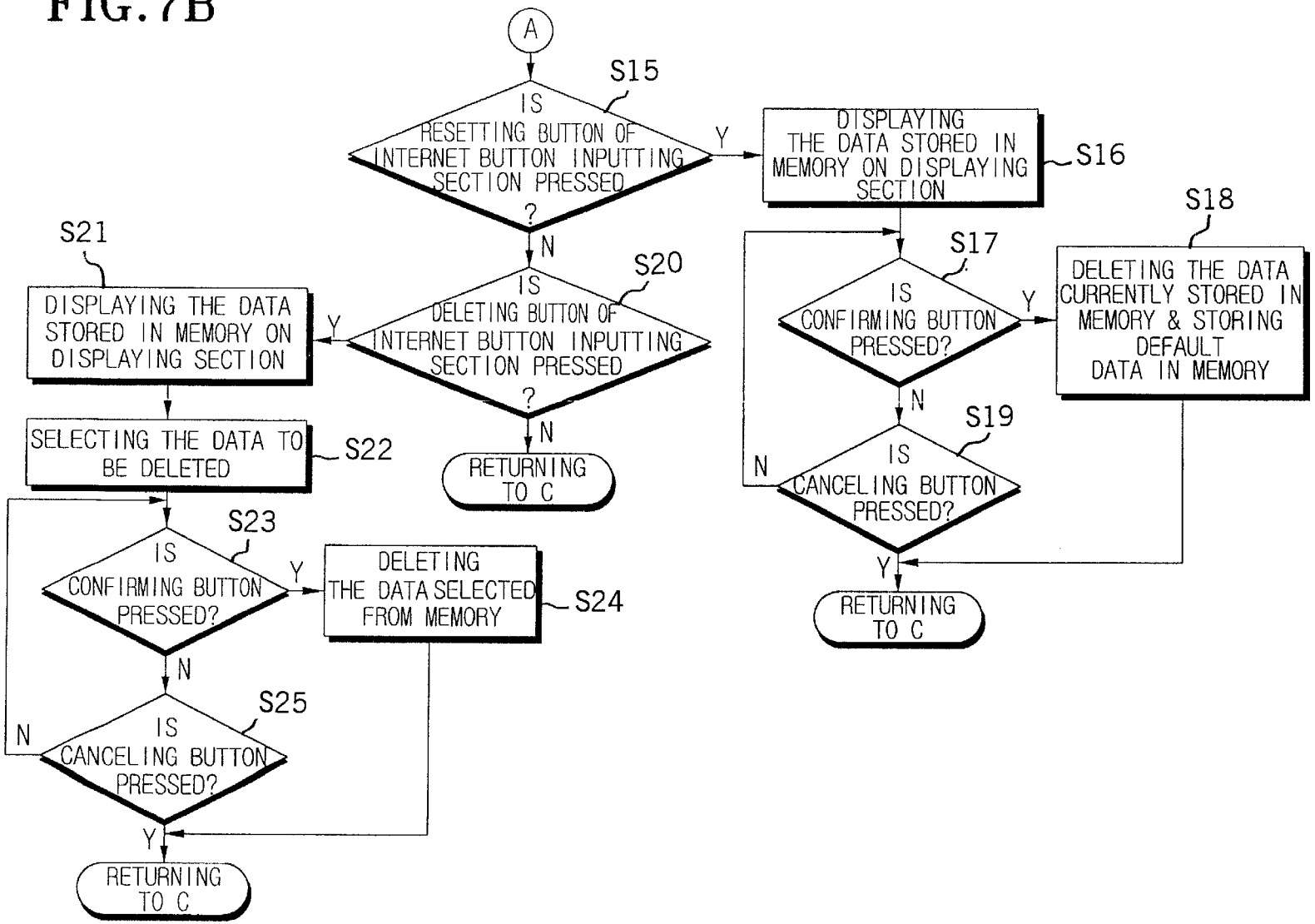

FIGS. 7A and 7B are flow charts which are linked by a reference character A for explaining the operation of the microwave oven according to the present invention.

The data receiving section 140 of the microwave oven 200 is connected with the RS232C serial port 310 of the personal computer 300 via the male jack 400 (See FIG. 4).

The user turns on the microwave oven 200, and connects the personal computer 300 to the Internet. The user receives the cooking data from the Web site of the Internet. That is, the user clicks the microwave oven cooking information (the menu name, power level, driving time, etc.) and thereby transfers the cooking data to the personal computer 300. The received data is outputted to the RS232C serial port 310 of the personal computer 300 by the communication program installed in personal computer 300. The output data is usually a pulse signal. The output data is inputted to the data receiving section 140 via the male jack 400. The data inputted to the data receiving section 140 is converted into a pulse signal of the proper voltage level for the microcomputer 100 at the interface section 144, and is then applied to the microcomputer 100.

When detecting the input of the pulse signal from the interface section 144 (step S1), the microcomputer 100 displays the cooking data inputted from the interface section 144 on the displaying section 30 (step S2). The cooking data includes the menu name, the power level, the cooking time, etc., and further includes the cooking conditions usually preset in the cooking menu of the microwave oven. The user can check the cooking data inputted from the Internet since the cooking data is displayed on the displaying section 30.

When detecting the input of the operation executing button 24 (steps S3 and S4), the microcomputer 100 performs the cooking operation according to the corresponding cooking data (step S4*b*). When completing the cooking operation, the microcomputer 100 returns to C to check if there is any button input (step S3).

When detecting the input of the bookmark button 131 (step S5) in a state where the cooking data from the Internet is displayed on the displaying section 30, the microcomputer 100 stores the displayed cooking data in the memory 150 (step S6), and returns to C. Meanwhile, when detecting the input of the bookmark button 131 in a state where the cooking data is not received from the Internet, or in a state where the cooking data is not displayed on the displaying section 301, the microcomputer 100 sequentially displays the cooking data stored in the memory 150 according to the number of bookmark button inputs.

Meanwhile, when the microcomputer 100 detects the input of the adjusting button 133 (step S7), the user is enabled to select the data to be adjusted from the input data by using the selecting button 135, and adjusts the selected input data (step S8) by inputting the buttons of the numeral inputting section 23. Then, the microcomputer 100 returns to C to check whether there is any button input (step S3).

When detecting the input of the replacing button 134 (step S9), the microcomputer 100 displays the whole range of cooking menus stored in the microcomputer 100 on the displaying section 30 (step S10). The user selects one of these pre-stored cooking menus to be replaced by the new cooking menu inputted from the Internet by using the selecting button 135 (step S11). When selecting the cooking menu to be replaced, the user presses the confirming button 136. When detecting that the confirming button 136 is pressed (step S12), the microcomputer 100 deletes the cooking data of the selected pre-stored cooking menu, and stores the cooking data of the cooking menu newly inputted from the Internet (step S13). Then, the microcomputer 100 returns to C to check whether there is any button input (step S3).

Meanwhile, when detecting that the canceling button 137 is pressed instead of the confirming button 136 (step S14), the microcomputer 100 does not store the cooking data displayed on the displaying section 30 inputted from the Internet, and returns to C to check whether there is any button input (step S3).

FIG. 7B is a flow chart which is a continuation of the flow chart of FIG. 7A for showing the process of controlling the microwave oven 200 when detecting the input of the resetting button 138.

When detecting the input of the resetting button 138 of the Internet command inputting section 130 (step S15), the microcomputer 100 displays the data stored in the memory 150 on the displaying section 30 (step S16). In such a situation, when determining that the confirming button 136 is pressed (step S17), the microcomputer 100 deletes the data currently stored in the memory 150, and stores the default data (step S18). The default data is the data pre-stored in the microcomputer 100. Further, when detecting that the canceling button 137 was pressed instead of the confirming button 136 (step S19), the microcomputer 100 returns to C. That is, after detecting the input of the resetting button 138, the microcomputer 100 keeps detecting the input of the confirming button 136 and the canceling button 137 to be accordingly operated by the button input result thereof.

Further, when detecting the input of the deleting button 132 (step S20), the microcomputer 100 displays the data stored in the memory 150 on the displaying section 30 (step S21). The user selects the data to be deleted by using the selecting button 135 (step S22). In such a situation, when detecting the input of the confirming button 136 (step S23), the microcomputer 100 deletes the selected data from the memory 150 (step S24). Further, when detecting the input of the canceling button 137 (step S25), the microcomputer 100 returns to C (step S3). As described above, after detecting the input of the deleting button 132 (step S20), the microcomputer 100 keeps checking for the input of the confirming button 136 or the canceling button 137 (steps S23 and S25).

When the microcomputer 100 does not detect any input from the resetting button 138 or the deleting button 132 (steps S15 and S20), the microcomputer 100 returns to C (step S3).

As described above, in accordance with the microwave oven and controlling method of the present invention, the user can cook food by using cooking data received from the Internet, and he/she may adjust, replace or store the cooking data from the Internet as he/she pleases. Accordingly, the user can make full use of the microwave oven since he/she can select and cook his/her desired cooking menus from a wide range of cooking menus provided by the Internet, and while also having the option of storing the cooking data for later use.

While the present invention has been particularly shown and described with reference to the preferred embodiments thereof, it will be understood by those skilled in the art that various changes in form and detail may be effected therein without departing from the spirit and scope of the invention as defined by the appended claims.

What is claimed is:

1. A microwave oven, comprising:

a data receiving section connected to an external device which is connectable to the Internet for receiving cooking data from the external device; and a driving section for performing cooking operations by using the cooking data received from the external device over the Internet;

wherein the data receiving section comprises phase-inverting means for phase-inverting the cooking data from the external device so as to convert the cooking data from the external device to a proper voltage level for a microcomputer in the microwave oven.

2. The microwave oven as claimed in claim 1, further comprising a displaying section for displaying the cooking data received from the external device, and a memory section for storing the cooking data received from the external device.

3. The microwave oven as claimed in claim 1, further comprising a user inputting section including a regular command inputting section for user input of regular microwave operating commands and an Internet command inputting section for user input of Internet commands for controlling reception and processing of the cooking data from the external device.

4. The microwave oven as claimed in claim 1, further comprising a user inputting section having an inputting part to adjust the cooking data received from the external device.

5. The microwave oven as claimed in claim 1, further comprising a user inputting section having a cooking menu storing part for pre-storing at least one cooking menu, and an inputting part for replacing the pre- stored cooking menu with the cooking data received from the external device, and for storing the cooking data received from the external device.

6. A microwave oven, comprising:

a data receiving section connected to an external device which is connectable to the Internet for receiving cooking data from the external device; and a driving section for performing cooking operations by using the cooking data received from the external device over the Internet;

wherein the data receiving section comprises an interface section, and wherein said interface section comprises a diode for detecting a signal from the external device to produce a pulse output, a transistor having a base, a collector and an emitter, and a resistor connecting said diode to said base for applying said pulse output to said base, said emitter being connected to ground, and said collector being connected by an additional resistor to a voltage source, said collector providing an output of the proper voltage level for the microcomputer in the microwave oven.

7. A controlling method for a microwave oven, comprising the steps of:

(a) receiving cooking data from an external device connected to the Internet; and (b) performing a cooking operation by using the cooking data received from the external device;

wherein step (a) includes phase-inverting the cooking data from the external device so as to convert the cooking data from the external device into a proper voltage level for a microcomputer in the microwave oven.

8. The controlling method as claimed in claim 7, wherein the cooking data comprises at least one of a menu name, an output power level and a cooking time.

9. The controlling method as claimed in claim 7, further comprising step (c) of storing the cooking data received from the external device.

10. The controlling method as claimed in claim 9, further comprising step (d) of replacing pre-stored cooking data with the cooking data received from the external device, and storing the cooking data received from the external device.

11. The controlling method as claimed in claim 10, further comprising step (e) of displaying the cooking data received from the external device.

12. The controlling method as claimed in claim 11, further comprising step (f) of adjusting the cooking data received from the external device.

13. The controlling method as claimed in claim 7, further comprising step (c) of replacing pre-stored cooking data with the cooking data received from the external device.

14. The controlling method as claimed in claim 7, further comprising step (c) of displaying the cooking data received from the external device.

15. The controlling method as claimed in claim 7, further comprising step (c) of adjusting the cooking data received from the external device.

16. A controlling method for a microwave oven, comprising the steps of:

(a) receiving cooking data from an external device connected to the Internet; and (b) performing a cooking operation by using the cooking data received from the external device;

wherein step (a) includes converting the cooking data from the external device into a proper voltage level for a microcomputer in the microwave oven by means of an interface section which comprises a diode for detecting a signal from the external device to produce a pulse output, a transistor having a base, a collector and an emitter, and a resistor connecting said diode to said base for applying said pulse output to said base, said emitter being connected to ground, and said collector being connected by an additional resistor to a voltage source, said collector providing an output of the proper voltage level for the microcomputer in the microwave oven.

17. A microwave oven, comprising:

a data receiving section connected to an external device which is connectable to the Internet for receiving cooking data from the external device; and a driving section for performing cooking operations by using the cooking data received from the external device over the Internet;

wherein the data receiving section comprises an interface section for converting the cooking data from the external device to a proper voltage level for the microcomputer in the microwave oven; and wherein said interface section includes a diode for detecting a signal from the external device to produce a pulse output, a voltage divider connected between said diode and ground for voltage-dividing the pulse output to produce a voltage divider output, and a Zener diode connected between said voltage divider and the ground for stabilizing the voltage divider output and produce a Zener diode output which is applied to the microcomputer in the microwave oven.

18. The microwave oven as claimed in claim 17, further comprising a displaying section for displaying the cooking data received from the external device, and a memory section for storing the cooking data received from the external device.

19. The microwave oven as claimed in claim 17, further comprising a user inputting section including a regular command inputting section for user input of regular microwave operating commands and an Internet command inputting section for user input of Internet commands for controlling reception and processing of the cooking data from the external device.

20. The microwave oven as claimed in claim 17, further comprising a user inputting section having a cooking menu storing part for pre-storing at least one cooking menu, and an inputting part for replacing the pre-stored cooking menu with the cooking data received from the external device, and for storing the cooking data received from the external device.

21. A microwave oven, comprising:

a data receiving section connected to a remotely located external device via an Internet for receiving cooking data from the remotely located external device over the Internet;

a driving section for performing cooking operations by using the cooking data received from the remotely located external device over the Internet;

an Internet command inputting section for user input of Internet commands for controlling reception of the cooking data from the remotely located external device; and a user inputting section for user input of regular microwave operating commands for processing the cooking data from the remotely located external device;

wherein said Internet commands includes a bookmark command for storing the cooking data received from the external device in memory under a specific identity in order to facilitate future retrieval.

22. The microwave oven as claimed in claims 21, wherein said Internet commands include a deleting command for deleting data, an adjusting command for adjusting data, and a replace command for replacing data.

23. The microwave oven as claimed in claim 22, wherein said Internet commands include a selecting command for selecting data and a confirm command for confirming a previous Internet command selection.

24. The microwave oven as claimed in claim 23, wherein said Internet commands include a cancel command for cancelling one of a current operation and a previously selected operation, and a reset command for resetting the microcomputer in the microwave oven.

25. A method of controlling a microwave oven in accordance with a button input from a user and a data input from an external device, comprising the steps of:

(a) determining whether a cooking data input has been received from the external device, and when the cooking data input is received from the external device, displaying the cooking data input on a display section;

(b) checking for the presence of the button input from the user;

(c) when an operation executing button is pressed by the user, performing a cooking operation, and then returning to step (b);

(d) when a bookmark button is pressed by the user, storing the cooking data input in memory under a specific identity in order to facilitate future retrieval of the cooking data, and then returning to step (b);

(e) when an adjusting button is pressed by the user, adjusting the cooking data input, and then returning to step (b);

(f) when a replacing button is placed by the user, displaying data prestored in memory on the display section, selecting data to be replaced, determining whether a confirming button is pressed by the user, and when the confirming button is pressed by the user, replacing the selected data, and then returning to step (b); and (g) when a canceling button is pressed by the user, returning to step (b).

26. The method as claimed in claim 25, further comprising the steps of (h) when a reset button is pressed by the user, displaying data stored in the memory on the display section, determining whether the confirming button is pressed by the user, and when the confirming button is pressed by the user, deleting data currently stored in the memory and storing default data in the memory, and when the confirming button is not pressed by the user and a canceling button is pressed by the user, returning to step (b); and (i) when the reset button is not pressed by the user and a delete button is pressed by the user, displaying the data stored in the memory on the display section, selecting data to be deleted, determining whether the confirming button is pressed by the user, and when the confirming button is pressed by the user, deleting the selected data from memory, and when the confirming button is not pressed by the user and the canceling button is pressed by the user, returning to step (b).

* * * * *